US007131937B2

(12) United States Patent
Skilken et al.

(10) Patent No.: US 7,131,937 B2
(45) Date of Patent: Nov. 7, 2006

(54) STANDING WEIGHTLIFTING APPARATUS

(75) Inventors: Stephen A. Skilken, Columbus, OH (US); Matthew A. Purdy, Reynoldsburg, OH (US)

(73) Assignee: Max Rack, Inc., Columbus, OH (US)

( * ) Notice: Subject to any disclaimer, the term of this patent is extended or adjusted under 35 U.S.C. 154(b) by 16 days.

(21) Appl. No.: 10/497,350

(22) PCT Filed: Nov. 30, 2001

(86) PCT No.: PCT/US01/44936

§ 371 (c)(1),
(2), (4) Date: Oct. 25, 2004

(87) PCT Pub. No.: WO03/047701

PCT Pub. Date: Jun. 12, 2003

(65) Prior Publication Data

US 2005/0054493 A1 Mar. 10, 2005

(51) Int. Cl.
*A63B 21/06* (2006.01)
*A63B 21/08* (2006.01)
*A63B 21/062* (2006.01)

(52) U.S. Cl. ..... 482/93; 482/97; 482/101

(58) Field of Classification Search ..... 482/92–94
See application file for complete search history.

(56) References Cited

U.S. PATENT DOCUMENTS

| | | | | | |
|---|---|---|---|---|---|
| 3,235,255 | A | | 2/1966 | Leflar | 272/81 |
| 4,357,010 | A | * | 11/1982 | Telle | 482/97 |
| 4,527,797 | A | * | 7/1985 | Slade et al. | 482/101 |
| 4,564,194 | A | * | 1/1986 | Dawson | 482/102 |
| 4,602,785 | A | | 7/1986 | Rockwell | 272/123 |
| 4,615,525 | A | | 10/1986 | Sutherland | 272/123 |
| 4,795,149 | A | * | 1/1989 | Pearson | 482/98 |
| 4,799,672 | A | | 1/1989 | Barrett | 272/123 |
| 4,836,535 | A | | 6/1989 | Pearson | 272/118 |
| D303,256 | S | | 9/1989 | Pearson | D21/198 |
| D303,697 | S | | 9/1989 | Pearson | D21/198 |
| 4,934,693 | A | | 6/1990 | Santoro | 272/123 |
| 4,955,604 | A | * | 9/1990 | Pogue | 482/99 |
| 4,982,957 | A | | 1/1991 | Shields | 272/123 |
| 5,050,868 | A | * | 9/1991 | Pearson | 482/94 |
| 5,151,072 | A | | 9/1992 | Cone | 482/104 |
| 5,184,992 | A | | 2/1993 | Banks | 481/104 |
| 5,215,510 | A | * | 6/1993 | Baran | 482/104 |
| 5,273,506 | A | | 12/1993 | Dawson, Jr. | 482/104 |
| 5,468,203 | A | | 11/1995 | Okonkwo | 481/104 |
| 5,569,133 | A | * | 10/1996 | Vittone | 482/98 |
| 5,669,859 | A | * | 9/1997 | Liggett et al. | 482/94 |
| 5,971,897 | A | * | 10/1999 | Olson et al. | 482/101 |
| 2002/0098953 | A1 | * | 7/2002 | Scheewe et al. | 482/94 |

* cited by examiner

OTHER PUBLICATIONS

PCT Notification of Transmittal of the International Search Report or the Declaration dated May 13, 2002.

*Primary Examiner*—Stephen R. Crow
*Assistant Examiner*—Arun Chhabra
(74) *Attorney, Agent, or Firm*—Standley Law Group LLP

(57) ABSTRACT

The present invention relates generally to exercising equipment, and more particularly, to an improved multi-use weight lifting apparatus. The present weight lifting apparatus comprises a frame (12), a vertical guide member (52), at least one horizontal guide member (46), a weight bearing bar (60), and a safety catch mechanism (70). This weight lifting apparatus allows a weight lifter to perform exercise with vertical and horizontal ranges of motion that simulate the natural motions of using free weights while providing safety mechanisms that are not available with free weights.

20 Claims, 1 Drawing Sheet

STANDING WEIGHTLIFTING APPARATUS

BACKGROUND AND SUMMARY OF THE INVENTION

The present invention relates generally to exercising equipment, and more particularly, to an improved multi-use weightlifting apparatus.

Weightlifters perform various exercises in order to develop muscles throughout the body. These exercises can be performed through the use of free weights, such as barbells, or by way of weightlifting machines. Many weightlifters prefer using free weights over machines because free weights allow the weightlifter to perform exercises in a natural motion while utilizing pure body leverage in performing the exercises. This allows the weightlifter to utilize many muscle groups simultaneously, to better isolate the muscles the exercise is intended to develop, and to mimic real athletic sports motions.

In many instances, a weightlifter utilizing free weights requires the assistance of a second person, commonly known as a spotter, during a weightlifting routine. A spotter functions as a "safety net" in order to prevent injury to the weightlifter. A spotter also functions to prolong the weightlifting exercise by providing just enough aid to the weightlifter during the weightlifting repetitions so that the weightlifter may complete additional repetitions beyond the point that the weightlifter could no longer lift the weights without assistance. This allows the weightlifter to improve muscle stamina and increase muscle mass.

However, a spotter is not always available to aid the weightlifter so the weightlifter may use a machine. Many weightlifting machines provide safety features that allow the weightlifter to complete his weightlifting exercises without the aid of a spotter and to terminate the exercise at anytime in the routine on his own without being injured by the weights.

Weightlifting machines also have drawbacks. Many weightlifting machines cannot perform all of the functions of a spotter. Also, many weightlifting machines do not allow a weightlifter to utilize many different muscle groups simultaneously or to isolate intended muscles. For example, many weightlifting machines only allow a lifting motion along a predetermined straight or arcuate path, thereby limiting the number of muscles that are worked during the lifting. In addition, many weightlifting machines can restrict a weightlifter's natural range of motion due to the mechanical limitations inherent in the machines.

A need exists to provide the weightlifter with the benefits of free weights and machines, while reducing the drawbacks of free weights and machines. The present invention is a weightlifting apparatus that is relatively simple in construction and use which allows the weightlifter to perform exercises in a natural, unrestricted motion while providing for the safety of the weightlifter. In addition, the present invention allows a weightlifter to perform squatting exercises with vertical and horizontal ranges of motion that simulate the natural motions of using free weights. This invention also provides a safety mechanism that is not available when free weights are used without a spotter.

An exemplary weightlifting apparatus of the present invention comprises a frame, horizontal and vertical guide members, a weight-bearing bar, a shoulder bar, and a safety catch mechanism. Specifically, the frame may be comprised of a single upright support member, two angled support members, a base and a top member. The upright support member and the two angled support members may form an inverted "Y" shape, while the top member may attach to the top end of the upright support member and the base may attach to the lower ends of the angled support members thereby defining the frame.

A horizontal guide member may be attached to the top end of the upright support member, while a second horizontal guide member may be attached to the lower end of the upright support member. The top end of a vertical guide member and a vertical safety bar may be attached to the upper horizontal guide member by a horizontal sleeve, while the lower end of the vertical guide member and the vertical safety bar may be attached to a lower horizontal guide member by another horizontal sleeve. Each horizontal sleeve may slide on its corresponding horizontal guide member allowing the vertical guide member and vertical safety member to move in a horizontal direction towards and away from the weightlifter.

A weight-bearing bar may be attached to the vertical guide member by a vertical guide sleeve. The vertical guide sleeve may move in a vertical direction along the vertical guide member as a weightlifter performs squatting exercises with the shoulder bar resting on his shoulders. Specifically, the squatting exercises may be performed by the weightlifter squatting while the shoulder bar is resting on his shoulders or by exerting an upward force on the shoulder bar. In an exemplary embodiment, the shoulder bar is angularly attached to the weight-bearing bar near its midpoint.

The safety mechanism may be comprised of a vertical safety bar with a plurality of openings evenly spaced on at least one side, at least one safety catch, and at least one handhold bar. A weightlifter may push the handhold bar away from his body to release the safety catch so that the weight-bearing bar is released and the exercises may be performed. When needed, the weightlifter may release the handhold bar to its resting position so that the safety catch will be inserted into one of the openings on the vertical safety bar, thereby locking the weight-bearing bar in position and removing the force of the weights from the weightlifter.

In an exemplary embodiment of the weightlifting apparatus, the components are comprised of strong and durable metal. The framework of the components may be rigidly fixed together by bolts, welding, rivets or any other similar, conventional, or suitable means.

In addition to the novel features and advantages mentioned above, other objects and advantages of the present invention will be readily apparent from the following descriptions of the drawings and exemplary embodiments.

BRIEF DESCRIPTION OF THE DRAWINGS

Referring now to the drawings.

DETAILED DESCRIPTION OF THE EXEMPLARY EMBODIMENT(S)

Figure 1:
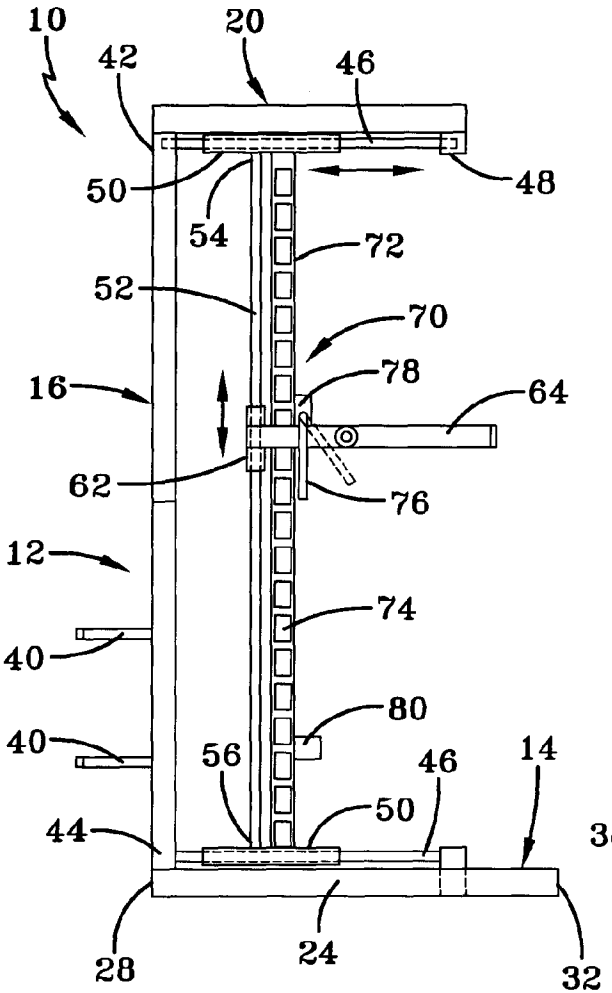
FIG. 1 is a side elevation view of an exemplary embodiment of the standing weightlifting apparatus.

The overall arrangement of an exemplary construction of the standing weightlifting apparatus 10 of the present invention is shown in FIG. 1. The present weightlifting apparatus has a frame 12, horizontal and vertical guide members 46, 52 respectively, a weight-bearing bar 60, a shoulder bar 64, and a safety catch mechanism 70.

The frame 12 is comprised of a base 14, an upright support member 16, angled support members 18, and a top member 20. The base 14 may have a back member 22 and two side members 24, 26, respectively. The first end 28, 30 of each side member 24, 26 may attach to each end of the back member 22, while the second end 32, 34 of each side member 24, 26 may remain free. The side members 24, 26 may be parallel to each other and perpendicular to the back member 22 of the base 14.

In this exemplary embodiment, an upright support member 16 is located perpendicular to and near the midpoint of the back member 22 of the base 14. Two angled support members 18 are attached to the upright support member 16 to provide support and stability to the frame 12 of the weightlifting apparatus 10. A first end 36 of a first angled support member 18 may be attached near the midpoint of the upright support member 16 while the second end 38 of the first angled support member 18 may be attached to the first end 28 of a side member 24 of the base 14. A second angled support member 18 may be attached to the opposite side of the upright support member 16 in the same manner as the first angled support member 18. In this example, the arrangement of the upright support member 16 and the two angled support members 18 form an inverted "Y" shape. In an exemplary embodiment of the weightlifting apparatus 10, any number of weight pegs 40 may be attached to the outside of the angled support members 18 for holding and storing weights that are not in use.

A top member 20 of the frame 12 may be attached to the top end 42 of the upright support member 16. The top member 20 may be perpendicular to the upright support member 16 and parallel to the side members 24, 26 of the base 14 of the frame 12.

A horizontal guide member 46 may be attached to the top end 42 of the upright support member 16 below the top member 20 of the frame 12. In an exemplary embodiment, this upper horizontal guide member 46 may be parallel to the top member 20 of the frame 12 and perpendicular to the upright support member 16. A second horizontal guide member 46 may be attached to the lower end 44 of the upright support member 16 above the base 14 of the frame 12. In an exemplary embodiment, this lower horizontal guide member 46 is parallel to the side members 24, 26 of the frame 12 and perpendicular to the upright support member 16. Both horizontal guide members 46 may include a guide stop 48 at end portion to limit the range of horizontal motion of the weightlifting apparatus 10. Specifically, the guide sleeve 50 may be stopped upon coming in contact with the respective guide stop 48 as it moved along the horizontal guide member 46.

A vertical guide member 52 may be attached by its upper end 54 to the upper horizontal guide member 46 by the guide sleeve 50 while the lower end 56 of the vertical guide member 52 may be attached to the lower horizontal guide member 46 by the other guide sleeve 50. Each guide sleeve 50 slides on its corresponding horizontal guide member 46 allowing the vertical guide member 52 to move in a horizontal direction toward and away from the weightlifter.

A weight-bearing bar 60 may be attached to the vertical guide member 52 by a guide sleeve 62. Also, the weight-bearing bar 60 may have a shoulder bar 64 attached to it. In this example, the shoulder bar 64 is attached angularly to a middle portion of the weight-bearing bar 60. The shoulder bar 64 is adapted to rest on the weightlifter's shoulders while the weightlifter performs exercises such as squatting exercises. Specifically, the squatting exercises may be performed by the weightlifter having the shoulder bar 64 resting on his shoulders. The weightlifter may lower himself and then return to a standing position by exerting an upward force on the shoulder bar 64. This may be repeated as many times as desired. As the weightlifter repeats this process, the guide sleeve 62 moves in a vertical direction along the vertical guide member 52. Additional weights may be placed on the ends 66 of the weight-lifting bar 60 as the weightlifter desires.

Figure 3:
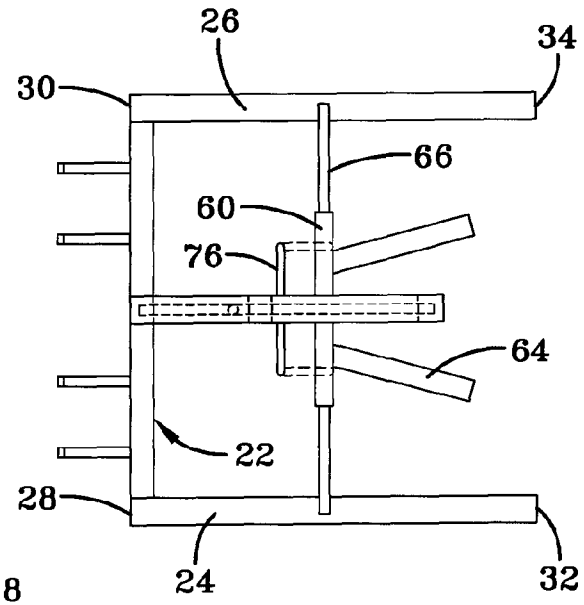
FIG. 3 is a top plan view of the exemplary embodiment of the standing weightlifting apparatus shown in FIG. 1.
Figure 2:
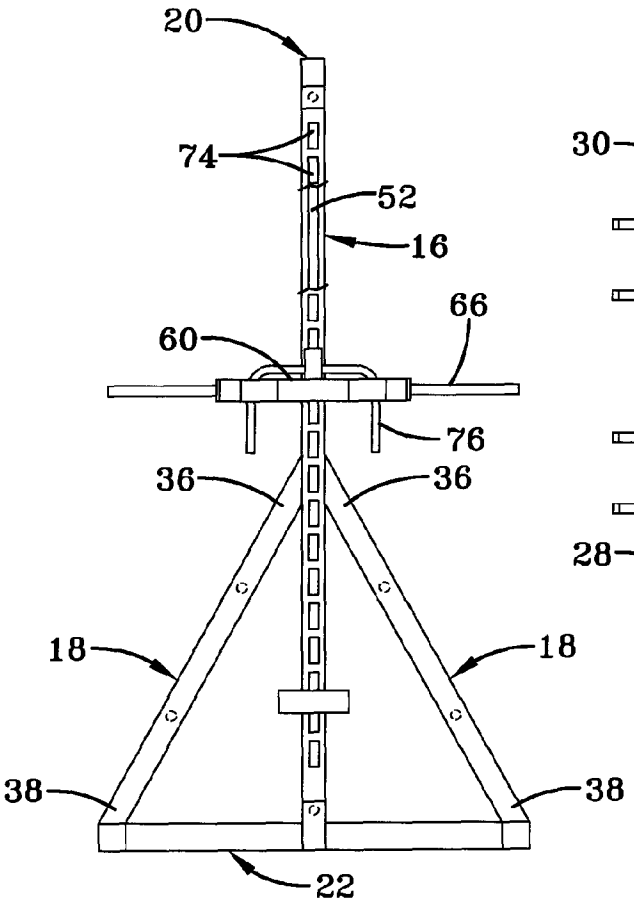
FIG. 2 is a front elevation view of the exemplary embodiment of the standing weightlifting apparatus shown in FIG. 1.

The exemplary weightlifting apparatus 10 also has a safety mechanism 70, which includes a vertical safety bar 72 with a plurality of openings 74 spaced on at least one side, at least one handhold bar 76, and at least one safety catch 78. In an exemplary embodiment of the present invention, the vertical safety bar 72 is parallel to and adjacent to the vertical guide member 52. The vertical safety bar 72 may be attached by its upper end to the upper horizontal guide member 46 by the guide sleeve 50. As shown in FIG. 2, the upper end of the vertical safety bar 72 and the upper end of the vertical guide member 52 may be attached to the same guide sleeve 50 that moves along the upper horizontal guide member 46. The openings 74 may be evenly spaced on at least one side of the vertical safety bar 72.

At least one handhold bar 76 may be adjacent to the weight-bearing bar 60 in front of the vertical guide sleeve 62. In an exemplary embodiment of the present weight-lifting apparatus 10 as shown in FIG. 2, two handhold bars 76 are symmetrically located adjacent to the weight-bearing bar 60. The safety catch 78 may be located at the end of the handhold bar 76 nearest the vertical safety bar 72. The weight-bearing bar 60 may be held at a rest position by hooking the safety catch 78 into one of the openings 74 on the vertical safety bar 72.

Specifically, a weightlifter can push the handhold bar 76 away from his body to release the safety catch 78 so that the weight-bearing bar 60 is released and the exercises may be performed. When needed, the weightlifter can release the handhold bar 76 to its resting position so that the safety catch 78 will be inserted into one of the openings 74 on the vertical safety bar 72, thereby locking the weighing-bearing bar 60 in position and removing the force of the weight-bearing bar 60 from the weightlifter. In an exemplary embodiment, the safety catch mechanism 70 is spring loaded, but may function in any other similar, suitable, or conventional manner.

One advantage of the exemplary safety catch mechanism 70 is that it is easier to engage and disengage than prior safety mechanisms. Many prior safety mechanisms required the weightlifter to twist the weight bar in an upward and backward direction until the hook portion was clear of the hooking pins. This twisting motion caused severe stress on the wrist muscles and joints. Additionally, if the bar was not twisted back far enough so that the hook portion of the catch mechanism did not clear the pins, subsequent vertical motion would be impeded as the hook portion would come in contact with the closest pin. Likewise with this type of safety mechanism, the weightlifter was required to hold the weight bar in the twisted position while exercising. If the weightlifter became fatigued and even slightly released the weight bar from its twisted position, the hook portion could unexpectedly come into contact with a pin preventing vertical motion and thereby injuring the weightlifter due to the unexpected stopping of the weight bar. The safety catch mechanism 70 of the exemplary weight-lifting apparatus 10 is relatively easier to use since it eliminates any twisting of the weight bar 60 and allows the weightlifter to engage and disengage the safety catch mechanism 70 in a more comfortable body position where less effort is required. Therefore, the weightlifter can focus more effort towards the actual lifting exercise.

The exemplary weightlifting apparatus 10 may also contain a vertical guide stop 80 near the bottom of the vertical safety bar 72. The vertical guide stop 80 is another safety feature that prevents the weight-bearing bar 60 from falling completely to the floor in the event that the safety catch mechanism 70 is not engaged. If the safety catch mechanism 70 is not engaged prior to the weight-bearing bar 60 reaching the vertical guide stop 80, the vertical guide stop 80 will automatically stop the weight-bearing bar 60 when they come in contact. The vertical guide stop 80 may prevent the weightlifter from inadvertently being pinned under the weight-bearing bar 60 in the event that the weightlifter becomes fatigued and cannot complete his lift In an exemplary embodiment, the vertical guide stop 80 is adjustable along the vertical safety bar 72 to suit the weightlifter's needs.

The exemplary embodiments of the present invention demonstrate the simultaneous horizontal and vertical motion that may be accomplished by the present weight-lifting apparatus 10. Due to the mobility of the weight-bearing bar 60 in the horizontal direction, as well as the vertical direction, a curved lifting motion can be accomplished by the present weightlifting apparatus 10. This curved lifting motion allows a weightlifter to perform the exercises in a natural, arched motion as if using free weights, while keeping the safety mechanisms 70, 80 provided by the mechanical elements of the machine.

Although the invention has been described primarily with regard to use with exercises performed in a standing position, it should be recognized that the invention may be implemented in other types of weightlifting machines. For example, the present invention may implemented in weightlifting machines that are adapted to be used by exercisers in other positions including, but not limited to, horizontal or inclined positions.

The components of the weightlifting apparatus 10 may be comprised of any desired materials having the necessary size and strength capabilities for use in a weight exercising apparatus. In the exemplary embodiments of the weightlifting apparatus 10, the components are comprised of strong and durable metal. The framework of the components may be rigidly fixed together by bolts, welding, rivets or any other similar, suitable, or conventional means.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A weightlifting apparatus comprising:

a frame;

a weight-bearing bar;

a single vertical guide member;

a vertical guide sleeve, wherein said vertical guide sleeve attaches said weight-bearing bar to said vertical guide member thereby allowing said weight-bearing bar to move in a vertical direction along said vertical guide member;

at least one horizontal guide members secured to said frame, said horizontal guide members having free ends;

a horizontal guide sleeves, wherein said horizontal guide sleeves attaches said vertical guide member to said horizontal guide members thereby allowing said vertical guide member to move in a horizontal direction along said horizontal guide members; and a safety catch mechanism.

2. The weightlifting apparatus of claim 1, further comprising at least one weight peg attached to said frame.

3. The weightlifting apparatus of claim 1, wherein said frame comprises:

a base;

an upright support member, said upright support member having a top end and a lower end;

two angled support members attaching said upright support member to said base; and a top member attached to said top end of said upright support member.

4. The weightlifting apparatus of claim 3, wherein said base comprises:

a back member having two ends; and two side members, each side member having a first end and a second end, said first end of each side member attached to a respective one of said ends of said back member, wherein said side members are parallel to each other and perpendicular to said back member.

5. The weightlifting apparatus of claim 1, wherein said weight-bearing bar has a shoulder bar angularly attached near a middle portion of said weight-bearing bar.

6. The weightlifting apparatus of claim 1, wherein said horizontal guide member further comprises a horizontal guide stop near said free end of said horizontal guide member thereby limiting the range of horizontal motion of said vertical guide member.

7. The weightlifting apparatus of claim 1, wherein said safety catch mechanism comprises:

a vertical safety bar having a plurality of openings spaced on at least one side;

at least one handhold bar, said handhold bar having two ends; and at least one safety catch.

8. The weightlifting apparatus of claim 7, wherein said vertical safety bar is parallel to and adjacent to said vertical guide member, said vertical safety bar attached to said horizontal guide members by said horizontal guide sleeves.

9. The weightlifting apparatus of claim 7, wherein said handhold bar is adjacent to said weight-bearing bar in front of said vertical guide sleeve.

10. The weightlifting apparatus of claim 7, wherein said safety catch is located at a respective one of said ends of said handhold bar nearest said vertical safety bar.

11. The weightlifting apparatus of claim 7, wherein said safety catch mechanism is spring loaded.

12. The weightlifting apparatus of claim 7, wherein said vertical safety bar further comprises a vertical guide stop.

13. The weightlifting apparatus of claim 1, wherein said safety catch mechanism is spring loaded.

14. A weightlifting apparatus comprising:

a bar adapted to hold weights;

a single vertical guide member;

a first guide sleeve connecting said bar to said vertical guide member thereby enabling said bar to move in a vertical direction along said vertical guide member;

at least one horizontal guide member; and a second guide sleeve connecting said vertical guide member to said horizontal guide member thereby allowing said vertical guide member to move in a horizontal direction along said horizontal guide member;

wherein said bar is adapted to be moved in all directions including a horizontal direction, a vertical direction, and directions including both a horizontal component an a vertical component.

15. The lifting apparatus of claim 14 further comprising a safety catch mechanism, said safety catch mechanism including:

a vertical safety bar having at least one opening on at least one side, said vertical safety bar attached to said horizontal guide member by said horizontal guide sleeve;

at least one safety catch adapted to be releasably secured in said at least one opening; and at least one handhold bar connected to said at least one safety catch, said at least one handhold bar adapted to be used to release said at least one safety catch from said at least one opening.

16. The lifting apparatus of claim 15 wherein said vertical safety bar further comprises a vertical guide stop.

17. The lifting apparatus of claim 14 further comprising:

a frame connected to said upper and said lower horizontal guide members.

18. The lifting apparatus of claim 17 wherein said frame comprises:

a base;

an upright support member, said upright support member having a top end and a lower end;

two angled support members attaching said upright support member to said base; and a top member attached to said top end of said upright support member.

19. The lifting apparatus of claim 18 wherein said base comprises:

a back member having two ends; and two side members, each side member having a first end and a second end, said first end of each side member attached to a respective one of said ends of said back member, wherein said side members are parallel to each other and perpendicular to said back member.

20. The lifting apparatus of claim 14 wherein said horizontal guide members further comprise a horizontal guide stops near said free ends of said horizontal guide members thereby limiting the range of horizontal motion of said vertical guide member.

* * * * *